US010253717B1

(12) United States Patent
Esposito et al.

(10) Patent No.: US 10,253,717 B1
(45) Date of Patent: Apr. 9, 2019

(54) CLOCK SIGNAL MONITORING APPARATUS AND METHOD

(71) Applicant: GM GLOBAL TECHNOLOGY OPERATIONS LLC, Detroit, MI (US)

(72) Inventors: Raffaele Esposito, Siano (IT); Tiziana Belvedere, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/826,762

(22) Filed: Nov. 30, 2017

(51) Int. Cl.
*F02D 41/22* (2006.01)
*F02D 41/26* (2006.01)

(52) U.S. Cl.
CPC ..... *F02D 41/26* (2013.01); *F02D 41/221* (2013.01)

(58) Field of Classification Search
CPC ..... F02D 41/22; F02D 41/26; F02D 41/221; F02M 65/00
USPC ..... 123/478, 479; 701/103, 107
See application file for complete search history.

(56) References Cited

U.S. PATENT DOCUMENTS

2011/0153145 A1* 6/2011 Kettenacker ..... B60W 50/04 701/31.4

* cited by examiner

*Primary Examiner* — Hai H Huynh
(74) *Attorney, Agent, or Firm* — Lorenz & Kopf LLP

(57) ABSTRACT

Methods and apparatuses are provided for detecting a defective internal clock signal. A signal transformer receives a clock signal having a duty cycle and a frequency and converts with the signal transformer the clock signal into a monitoring signal having a peak value related to the duty cycle and to the frequency of the clock signal. A detector is connected to the signal transformer to receive the monitoring signal and generates an error signal when the peak value of the monitoring signal is outside a predefined range.

20 Claims, 9 Drawing Sheets

CLOCK SIGNAL MONITORING APPARATUS AND METHOD

TECHNICAL FIELD

The present disclosure generally relates to the field of automotive engine control and more particularly relates to a clock signal monitoring apparatus, a control unit for vehicles, a method for monitoring a clock signal and a non-transitory program element.

BACKGROUND

This section provides background information related to the present disclosure which is not necessarily prior art.

Inside an injector drive controller, an injection driving device and/or an injector driver a clock signal is used for controlling the different functionalities of the controller and/or of the injector driver. One possible functionality may be provision of a control signal for an injector, and/or an injector needle. For this purpose, an actual injector driver may use an external clock signal generated by an external clock source. In general, a microcontroller may provide the external clock signal to the injection driving device. The injection driving device may condition the external clock signal and generate a signal for driving the injector. The injector driver may be connected to the injector which is the mechanical and/or electrical component acting according to the driving signals provided by the injector driver. The injector driver substantially hides the clock signals from the injector, since the injector driver is located between the external clock source and the injector.

Inside the injector driver a clock signal monitoring apparatus or an internal clock unit is provided to handle the clock signals. For safety reason in addition to the received external clock signal, the controller and/or injector driver may generate an internal clock signal in the clock signal monitoring apparatus. In this way, the internal clock signal may be used to monitor and/or to verify the external clock signal. In addition, the injector driver may use an internal clock source which generates the internal clock signal as a backup clock source in case of detecting faulty conditions in any of the clock signals. In an example, the internal clock source is located inside the clock signal monitoring apparatus or inside the internal clock unit. In particular, actual devices for driving an injector of an engine are equipped with such an internal clock which may be used to detect a faulty external clock signal.

However, the internal clock signal generated by the internal clock source may be assumed as to be more reliable than the external clock signal. Therefore, an actual control strategy may provide for always switching to the internal clock signal when any discrepancy between the external clock signal and the internal clock signal is detected. In this control strategy, the external clock signal may be always considered as to be defective when an error will appear. If the external clock is considered as to be faulty, the injector driver switches over to the internal clock in order to drive a respective automotive component, such as the injector. If, however, the injector driver may be predetermined to always switch to the internal clock after detecting faulty conditions, the controller or injector driver may switch to the internal clock signal and/or to the internal clock, even in cases where the internal clock signal is the source for the signal discrepancy. But, using the erroneous internal clock signal may result in missing injections. Missing injections may cause the engine to work inefficiently, to use the wrong quantity of injected fuel, to generate a wrong pulse width and/or may cause the engine to stall.

Accordingly, it is desirable to provide an efficient engine control strategy. In addition, it is desirable to detect a defective internal clock signal. Furthermore, it is desirable to detect an erroneous internal clock signal independently from the external clock signal. It is also desired to decide which one of two clock signals may be the defective signal. Furthermore, other desirable features and characteristics of the present invention will become apparent from the subsequent detailed description and the appended claims, taken in conjunction with the accompanying drawings and the foregoing technical field and background.

SUMMARY

A clock signal monitoring apparatus and/or an internal clock unit is provided for monitoring an internal clock signal. In one embodiment, the clock signal monitoring apparatus includes a signal transformer configured to receive the clock signal having a duty cycle and a frequency and to convert the clock signal into a monitoring signal having a peak value related to the duty cycle and/or related to the frequency of the clock signal. In one embodiment, the duty cycle of the clock signal may be linked to the mean value of the monitoring signal. In another embodiment, the frequency of the clock signal may be linked to the amplitude of the monitoring signal, in particular to the ripple of the monitoring signal and/or to the peak-to-peak value of the monitoring signal. Both the mean value and the amplitude may have impact to the peak value of the monitoring signal. The clock signal monitoring apparatus further include a detector in communication with the signal transformer and configured to receive the monitoring signal and to generate an error signal when the peak value of the monitoring signal is outside of a predefined range. In other words, either a duty cycle deviation from a preset duty cycle and/or a frequency deviation from a preset frequency of the clock signal may change the peak value of the monitoring signal. Therefore, when an error in the clock signal is due to a change in the duty cycle and/or due to a change of the frequency such an error may become visible by an amended peak value of the monitoring signal. In one embodiment, the monitoring signal may be a triangular waveform signal. The clock signal monitoring apparatus and/or the internal clock unit may include analog components in order to implement the described control and/or monitoring strategy in a substantially purely analog design.

The clock signal monitoring apparatus may include a low pass filter. In an embodiment, the low pass filter may have a cut-off frequency such that a mean value of the monitoring signal is proportional to the duty cycle of the clock signal and a ripple of the monitoring signal is proportional to the frequency of the clock signal. In another embodiment, the low pass filer may have a cutoff frequency equaling one-tenth of the frequency of the clock signal.

The detector may include a peak value comparator configured to compare the peak value of the monitoring signal to at least one of a first boundary value of the predefined range and a second boundary value of the predefined range, which is greater than the first boundary value, and output an out-of-range signal for the time during which the peak value is below the first boundary value or the peak value is above the second boundary value. In one embodiment, the detector may include a debouncer configured to receive the out-of-range signal and to increase a debouncer output signal over the time the peak value comparator outputs the out-of-range signal. The detector may further include an error signal generator configured to compare the debouncer output signal to a predefined threshold and to generate the error signal when the debouncer output signal is greater than the predefined threshold.

According to another embodiment of the present disclosure, a control unit, an injector driver for a vehicle and/or an arbitration module is provided including an external clock signal terminal configured to provide an external clock signal, an internal clock signal terminal configured to provide an internal clock signal and the clock signal monitoring apparatus or the internal clock unit. The signal transformer of the clock signal monitoring apparatus is connected to the internal clock signal terminal in order to monitor the internal clock signal.

Furthermore, a method for monitoring a clock signal is provided. In one embodiment, the method includes receiving a clock signal having a duty cycle and a frequency in a signal transformer. The method further includes converting the clock signal with the signal transformer into a monitoring signal having a peak value related to the duty cycle and to the frequency of the clock signal. This monitoring signal is provided to a detector, which is connected to the signal transformer. The method further includes generating an error signal by the detector when the peak value of the monitoring signal lies outside a predefined range.

In an embodiment, the method may further include transmitting a second clock signal from a second clock source when an error signal is generated.

In an embodiment, the method may further include comparing the peak value of the monitoring signal to at least one of a first boundary value of the predefined range and a second boundary value of the predefined range, which is greater than the first boundary value, and outputting an out-of-range signal for the time during which the peak value is below the first boundary value or the peak value is above the second boundary value.

In an embodiment, the method may further include increasing a debouncer output signal over a time period that the out-of-range signal is outputted. In another embodiment, the method may further include generating an error signal when the debouncer output signal is greater than the predefined threshold.

In addition, a non-transitory program element is provided. In one embodiment, the non-transitory program element includes a software code, which, when being executed by a processor, executes a method for monitoring a clock signal. Furthermore, a non-transitory computer readable medium is provided, including software code, which when executed by a processor executes a method for monitoring a clock signal.

DESCRIPTION OF THE DRAWINGS

The exemplary embodiments will hereinafter be described in conjunction with the following drawing figures, wherein like numerals denote like elements.

FIGS. 6A-1, 6A-2 and 6B are collections of plots representing output signals of different components of the clock signal monitoring apparatus as a function of time where the frequency of the monitored clock signal is outside a tolerance range according to an exemplary embodiment of the present disclosure;

DETAILED DESCRIPTION

The following detailed description is merely exemplary in nature and is not intended to limit the invention disclosed herein or the application and uses of the invention disclosed herein. Furthermore, there is no intention to be bound by any principle or theory, whether expressed or implied, presented in the preceding technical field, background, summary or the following detailed description, unless explicitly recited as claimed subject matter.

Figure 1:
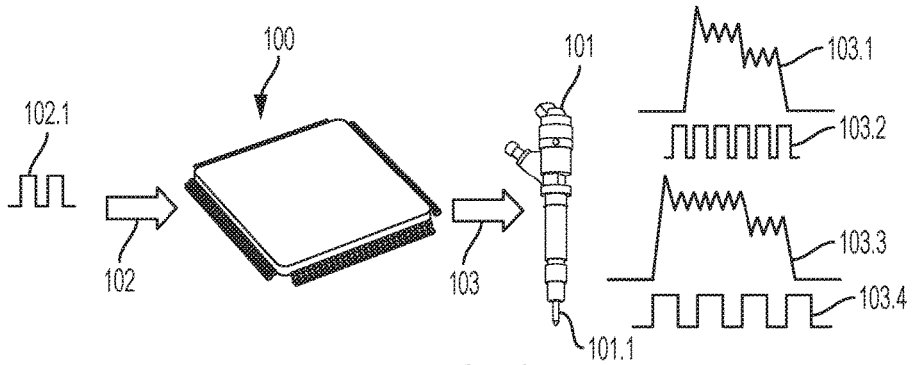
FIG. 1 shows an injector driver for a better understanding of this disclosure.

FIG. 1 is an injection driving device 100, an injector driver 100 and/or an injector drive controller 100 for an injector 101 and is shown for a better understanding of this disclosure. One functionality of the injection driver 100 may be driving the injector 101 by a driving signal 103. This driving functionality may be based on a clock signal in order to control the correct timing of injections. For safety reason, the injector driver 100 when deriving the control signal for the injector 101 may not only rely on a single clock source, e.g. an external clock source. Thus, even if the external clock source such as a microcontroller (not shown in FIG. 1) may provide an external clock signal 102.1 with a high accuracy, the injector driver 100 may for redundancy reason be equipped with an internal clock source (not shown in FIG. 1). The internal clock source may be used as a backup clock source or as a redundant clock source that can be used for detecting deviations in the external clock signal 102.1. The internal clock source may also be used to replace a defective external clock source by switching over to the internal clock source in case of errors. In order to identify a failure in the external clock signal, the controller 100 may monitor the external clock signal 102.1 as well as the internal clock signal. Failures in the external clock signal 102.1 may be detected by comparing the external clock signal 102.1 to the internal clock signal. The device 100 for providing the drive signal for injector 101 receives this external clock signal 102.1 to be monitored via external clock signal input port 102. An output terminal or port 103 of injector driver 100 is connected to an injector 101 which uses the drive signal 103.1, 103.2 derived from the clock signal for driving the injector needle 101.1.

FIG. 1 also shows two schematic timing diagrams 103.1 and 103.3 of a control signal for an injector 101 which are provided on the output 103 of injector driver 100. Timing diagram 103.1 is based on a correct clock signal 103.2 and timing diagram 103.3 is based on a defective clock signal 103.4. Under normal working conditions, the injector driver 100 provides the control signal 103.1 or drive signal 103.1 at the output port 103. The control signal 103.1 is based on the clock signal 103.2 which is in range. The timing of the clock signal 103.2 is within a predefined range and therefore the output signal 103.1 can be used to drive the injector 101. If, however, the injector driver 100 is provided with a faulty clock signal 103.4, the injector driver 100 may supply an out of range control signal 103.3 to the injector 101. Such a defective control signal 103.3 may appear in a case where the clock signal 103.4 is out of a predefined range. The valid range of a clock signal may be defined by a predetermined duty cycle and/or by a predetermined frequency. In the example of defective control signal 103.3, the clock signal 103.4 has a reduced frequency compared to the frequency of regular clock signal 103.2. Such a defective clock signal 103.4 may appear if the external clock signal 102.1 is used but the signal itself is in a faulty condition. Such a faulty signal 103.4 may also appear if a failure occurs in the internal clock signal and the injector driver 100 switches to this faulty internal clock signal even if the external clock signal may be working correctly.

In order to prevent such faulty conditions, a location of a defective clock signal is to be detected as soon as possible so that the injector driver 100 may switch to the internal clock signal when the external clock signal is identified as being defective. Alternately, the injector driver 100 may prevent switching to the internal clock signal if the internal clock is identified as source of failure. If the external clock signal 102.1 is detected to have failures, for example if the external clock signal is not available or is out of the predefined range, the internally generated backup clock signal may be used to generate a driving signal in order to drive the injector 101. The injection timing of the fuel to be provided to an engine is linked to the driving signal. Switching over to the internal clock signal may prevent stalling or stopping of the engine, provided that the internal clock signal is operating correctly. In order to monitor the external clock signal 102.1, the internal clock is used as a comparison signal for the external clock and as long as no failures are detected, the external clock signal 102.1 is used as a basis for a control signal 103.1 that is provided to the injector 101 via the output terminal 103 of the injector driver 100. The internal clock or the internal clock signal is additionally used as a backup device and backup signal, respectively. However, in order to use the internal clock signal as a reference signal and/or as a backup signal, an additional functionality may be suggested for distinguishing failure conditions between the external clock signal and/or for identifying the location of the failure.

Identifying the location of the source of failure may prevent the injector driver 100 to make a misinterpretation of the external clock signal 102.1 when the internal clock has a problem or is faulty. Consequently, if the internal clock signal has a defect, the control algorithm may prevent switching to the internal clock. Thus, the engine may be protected from receiving a wrong injection quantity, the pulse width may be monitored correctly and/or engine stalling may be prevented.

Figure 2:
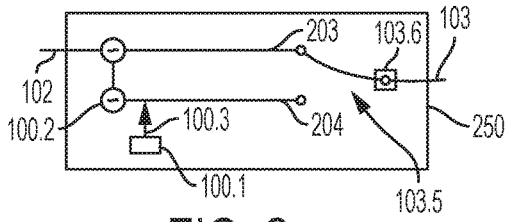
FIG. 2 is a schematic block diagram of a clock signal arbitration module including a clock signal monitoring apparatus according to an exemplary embodiment of the present disclosure.

FIG. 2 is a schematic block diagram of a clock arbitration module 250 including a clock signal monitoring apparatus 100.1 of an injector driver 100 according to an exemplary embodiment of the present disclosure. The injector driver 100 is not shown in FIG. 2. The clock arbitration module 250 has an input terminal 102 for receiving an external clock signal and may be configured to condition and/or modify the external clock signal 102.1 if necessary and to provide the external clock signal to the external clock signal output 203 of the clock arbitration module 250. In this way, the external clock signal is provided to an output of the injector driver 100. The clock arbitration module 250 also has an internal clock signal output terminal 204 for providing an internal clock signal. Both output terminals 203, 204 may form a common output terminal 103 which can provide an actual driving signal for an injector 101 (not shown in FIG. 2). The driving signal is derived from a respective clock signal. The common output terminal 103 may include a switch-over-device 103.6 or switch 103.6 which is configured to select the correct clock signal and to condition the driving signal 103.1, 103.2 according to the selected clock signal. The driving signal is provided from the injector driver 100 to the injector 101 via link 103. In one example, inside the clock arbitration module 250 switch 103.6 may be configured to select the clock signal which is to be used for generating the driving signal for the injector 101. The switch 103.6 is connected to the output terminal 103 of the injector driver 100. In an example, the switch 103.6 may be controlled by the clock signal monitoring apparatus 100.1. The driving signal 103.1, 103.2 for injector 101 which is provided via output port 103 may be derived from one clock signal selected from the group of clock signals consisting of the internal clock signal generated by an internal clock 100.2 and the external clock signal 102.1. The external clock signal 102.1 may be provided via external clock signal output 203 and the internal clock signal may be provided via internal clock signal output 204. The clock signal monitoring apparatus 100.1 does not receive the external clock signal 102.1 in order to be able to operate independently from the external clock signal.

The internal clock, internal clock source or internal clock generator 100.2 is used to generate an internal clock signal inside injector driver 100. The internal clock 100.2 may generate the internal clock signal independently from the external clock signal received on an input port 102. The clock signal monitoring apparatus 100.1 has a sense connection 100.3 in communication with internal clock 100.2 in order to provide the internal clock signal to the clock signal monitoring apparatus 100.1. The clock signal monitoring apparatus 100.1 is adapted to determine whether the internal clock signal provided from an internal clock source 100.2 has a correct or wrong timing independently from the external clock signal. The clock signal monitoring apparatus 100.1 is capable to distinguish a faulty condition of the internal clock signal independently from the external clock signal. This independency may allow for determining a defect in the internal clock signal and/or the internal clock 100.2.

Implementing the clock signal monitoring apparatus 100.1 as a self-sufficient purely analog circuit may allow for detecting an irregularity of the internal clock signal independently from substantially any external input and in particular independently from the external clock signal. The purely analog circuit may be built by hardware components and may substantially be software-less. Such implementation may also be used to correctly identify the location of an erroneous clock signal. In particular, the internal clock 100.2 may be identified as the source of a deviating clock signals and switching to the internal clock signal may be prevented. In this way, the risk of engine stall in case the internal clock 100.2 is wrongly chosen as clock source may be minimized. Furthermore, the safety of the vehicle using such a driver 100 and the customer satisfaction maybe increased. The clock signal monitoring apparatus 100.1 may be used in injector driver 100 that use a backup clock or a redundant clock for monitoring an external clock signal. For example, such a clock signal monitoring apparatus 100.1 may be retrofitted in an existing injector driver 100 using at least two redundant clock sources 100.2, 102. In an example where a plurality of clock sources is employed the switch 103.6 may be adapted to select from a plurality of clock sources.

A faulty condition of the internal clock 100.2 may include a frequency deviation and/or a situation where a duty cycle of the internal clock signal is out-of-range. The strategy of handling at least two clock sources, 102, 100.2 within one injector driver 100 as presented in this disclosure may involve the following considerations. The internal clock signal may substantially be a square wave signal with a constant frequency and a constant duty cycle. By applying this internal clock signal to a low pass filter a substantially triangular waveform having a constant mean value may be generated and provided on the output of the low pass filter. The mean value of the triangular signal may be directly linked to the duty cycle of the clock. The triangle waveform amplitude or the ripple of the triangle waveform may be directly linked to the clock frequency. If the clock frequency or duty cycle may be outside of an acceptable range, it is possible to detect such an exceeding of an acceptable range by analyzing the peak value of the filtered signal. In order to not rely on the external clock, all the circuitries used for detecting the internal clock fault may be designed as analog circuits and as being independent from the external clock.

Figure 3:
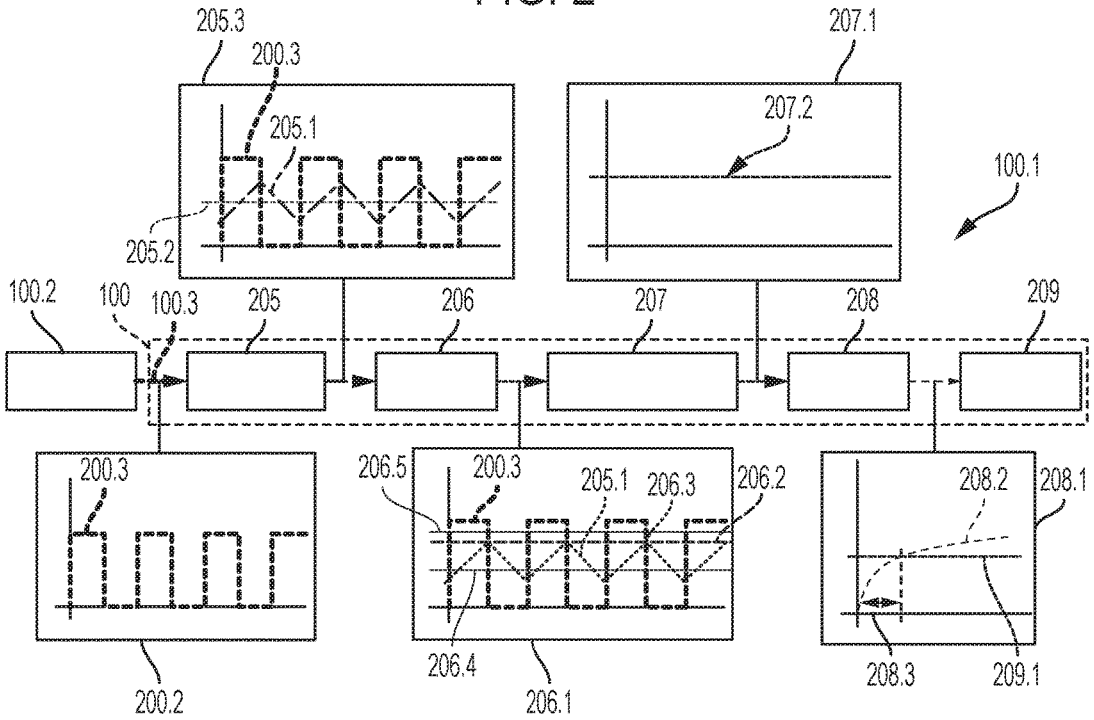
FIG. 3 is a schematic functional diagram of a clock signal monitoring apparatus according to the present disclosure.

FIG. 3 is a schematic functional diagram of the components used to build the clock signal monitoring apparatus 100.1 according to an exemplary embodiment of the present disclosure. The clock signal 200.3 or the internal clock signal 200.3 generated by internal clock signal source 100.2 is a square wave signal 200.3 with a constant frequency and a constant duty cycle. This constant frequency and constant duty cycle may be predefined in order to provide a regular signal. An example of the clock signal is shown in diagram 200.2. This clock diagram 200.2 shows the internal clock signal 200.3 as a square wave signal plotted as a voltage signal over time.

Via sense line 100.3, the internal clock signal 200.3 is provided to the signal monitoring apparatus 100. In particular, the internal clock signal 200.3 is provided to transformer 205. The transformer 205 includes a low pass filter. The low pass filter or transformer 205 receives the rectangular clock signal 200.3 and converts the signal to a triangular waveform 205.1. This triangular waveform 205.1 has a mean value 205.2 and is shown in diagram 205.3 as a voltage curve 205.1 over the time. The internal clock signal 200.3 is also shown in diagram 205.3 in order to demonstrate how the rectangular clock signal 200.3 is transformed into a triangular signal 205.1. The mean value 205.2 may be constant and may be an indication of the peak-to-peak variation of triangular signal 205.1. In more detail, the low pass filter of transformer 205 may have a defined cut-off frequency.

This cut-off frequency of the low pass filter is configured such that rectangular clock signal 200.3 is converted into the triangular signal 205.1 having a mean value 205.2 that is directly linked to the duty cycle of the clock signal 200.3. Furthermore, the cut-off frequency is configured such that the amplitude and/or ripple of the triangular waveform 205.1 is directly linked to the clock frequency of the clock signal 200.3. This relationship between duty cycle and/or frequency and mean value and amplitude, respectively may allow for evaluating whether the duty cycle and/or frequency are in a predefined tolerance range. If the clock frequency and/or duty cycle is/are out of an acceptable range, it is possible to detect this defect in the signal by analyzing the peak value of the filtered signal. In order to generate a peak value 206.3 of the triangular signal 205.1, an active peak detector 206 is provided in the signal path of clock signal monitoring apparatus 100.

The peak signal 206.2 generated by the peak detector 206 is shown in diagram 206.1 as a voltage curve 206.2 over time. The peak signal 206.2 generated by active peak detector 206 may substantially correspond to edges 206.3 and/or peak values 206.3 of the triangular waveform 205.1. In other words, once a maximum value 206.3 of curve 205.1 is detected this value 206.3 is substantially maintained as peak value curve 206.2. A tolerance range may be defined by lower boundary value 206.4 and upper boundary value 206.5. As long as peak value 206.3 and/or a corresponding peak value curve 206.2 fall(s) inside this tolerance range 206.4, 206.5 the corresponding clock signal is assumed as to be acceptable. In other words, if the peak values 206.3 of triangular wave 205.1 lie in this tolerance range between 206.4 and 206.5, the internal clock signal 200.3 is meeting the predefined condition and the internal clock signal 100.2 is assumed as working correctly. As such, the internal clock signal 200.3 generated by internal clock 100.2 can be used as a reference for monitoring external clock signal 102.1 and/or as a backup clock source if the external clock signal fails. Thus, by transforming the clock signal 200.3 into a triangular signal 205.1 and monitoring the peak values 206.2 of the triangular signal 205.1 it is possible to detect the validity of the signal. The monitoring operation may comprise comparing the peak value curve 206.2 of the filtered signal with the predefined range 206.4, 206.5. Reducing the monitoring operation to a comparison of peak values 206.2 with border values 206.4, 206.5 may prevent analyzing of any other signal and may reduce the complexity of the circuit.

The borders 206.4 and 206.5 of the range are monitored by a comparator for out-of-range detection 207 that is adapted or configured for detecting peak signal 206.2 and/or peak values 206.3 exceeding at least one of limit values 206.4, 206.5 or thresholds 206.4, 206.5. During the time where peak signal 206.2 and/or peak values 206.3 lie between borders defined by comparator 207, the comparator 207 generates substantially no output signal or an output signal which is very close to 0 V. The output signal of comparator 207 is shown in diagram 207.1. The high value 207.2 that is shown in diagram 207.1 of FIG. 3 shows that comparator 207 detected an exceeding of one limit of the upper limit 206.5 and the lower limit 206.4. With regard to FIG. 3 it is to be noted that peak value curve 206.2 is existing whether the curve 206.2 is in range or out of range, the output of comparator 207 however, only reaches value 207.2 during the time peak value 206.2 falls out of range 206.4, 206.5. In other words, the dotted line 207.2 in diagram 207.1 only indicates the high value that could be reached during the time the peak value 206.2 falls out of range 206.4, 206.5 and is not the signal belonging to diagram 206.1 where peak value curve 206.3 is within the range 206.4, 206.5. An alternative interpretation of curve 207.2 may be that this curve indicates a signal belonging to a time duration where curve 206.2 is out of range.

The output signal 207.2 or clockNOK signal 207.2 of comparator 207 may be a constant high voltage or a constant low voltage (0 V) dependent on the quality of the clock signal 200.3. When the internal clock signal 200.3 is within the predetermined range 206.4, 206.5, a low signal (0 V) is provided at the output of comparator 207. When the internal clock signal 200.3 is outside of range 206.4, 206.5 and defective, a high signal 207.2 is provided at the comparators' 207 output. The output signal 207.2 of comparator 207 provides the corresponding signal to debouncer 208. Debouncer 208 generates signal which increases over time in case of an error condition where a high signal 207.2 is provided from comparator 207 to debouncer 208. Debouncer 208 in combination with a comparator substantially makes a stable condition out of a varying input signal in order to provide a stable signal indicating an error condition. Debouncer 208 holds its output to a stable error signal once an error situation has been existing over a tolerable time period. Output signal 208.2 of debouncer 208 is shown in diagram 208.1 as time variant signal 208.2. For the example of diagram 208.1 a failure situation at the time of the origin of the diagram may be assumed letting signal 208.2 increase from the origin of the diagram 208.1. The increasing signal 208.2 is caused by a high signal 207.2 during the time peak value curve 206.2 lies outside of range 206.4, 206.5. The debouncer signal 208.2 is compared to a threshold value 209.1 set by output comparator 209 which is in communication with debouncer 208. A fault detection is assumed when the debouncer output signal 208.2 exceeds threshold 209.1. Setting a threshold value therefore may allow for providing a hysteresis 208.3, a minimum detection time 208.3 and/or a delay 208.3 before an actual warning message may be generated by the clock signal monitoring apparatus 100.1. In other words, such a limit value 209.1 may allow for delaying the provision of an error indication and therefore, such a delay may be provided in order to accept a temporary error condition of the internal clock signal 200.3. Or in yet other words the limit value 209.1 may allow to vary the sensitivity of the circuit to an error condition. In this way by moving the threshold value 209.1, a delay 208.3 or reaction time 208.3 can be pre-set as desired. The reaction time 208.3 is defined as the time between the first moment when peak value 206.3 of triangular signal 205.1 exceeds the tolerance range 206.4, 206.5 and the moment when the debouncer output signal 208.2 reaches threshold 209.1. This threshold value 209.1 defines a timely tolerance range whilst limit values 206.4, 206.5 define a frequency and/or duty cycle tolerance range. During the time range 208.3 the clock signal may be assessed as faulty or not OK (clockNOK). Reaching the threshold 209.1 may directly link with a clock fault signal "clockfault" provided on an output of output comparator 209. If, for example, only a short-term deviation (clockNOK) of the clock signal appears, whose duration is below the time tolerance range 208.3, the limit value 209.1 will not be exceeded and the signal deviation from the pre-set values may not be recognized by the clock signal monitoring apparatus 100.1. The clock signal monitoring apparatus 100.1 includes the signal transformer 205 or low pass filter 205, the active peak detector 206 or peak value comparator 206, the comparator 207 for out-of-range detection, the debouncer 208 and the output comparator 209.

Figure 4A:
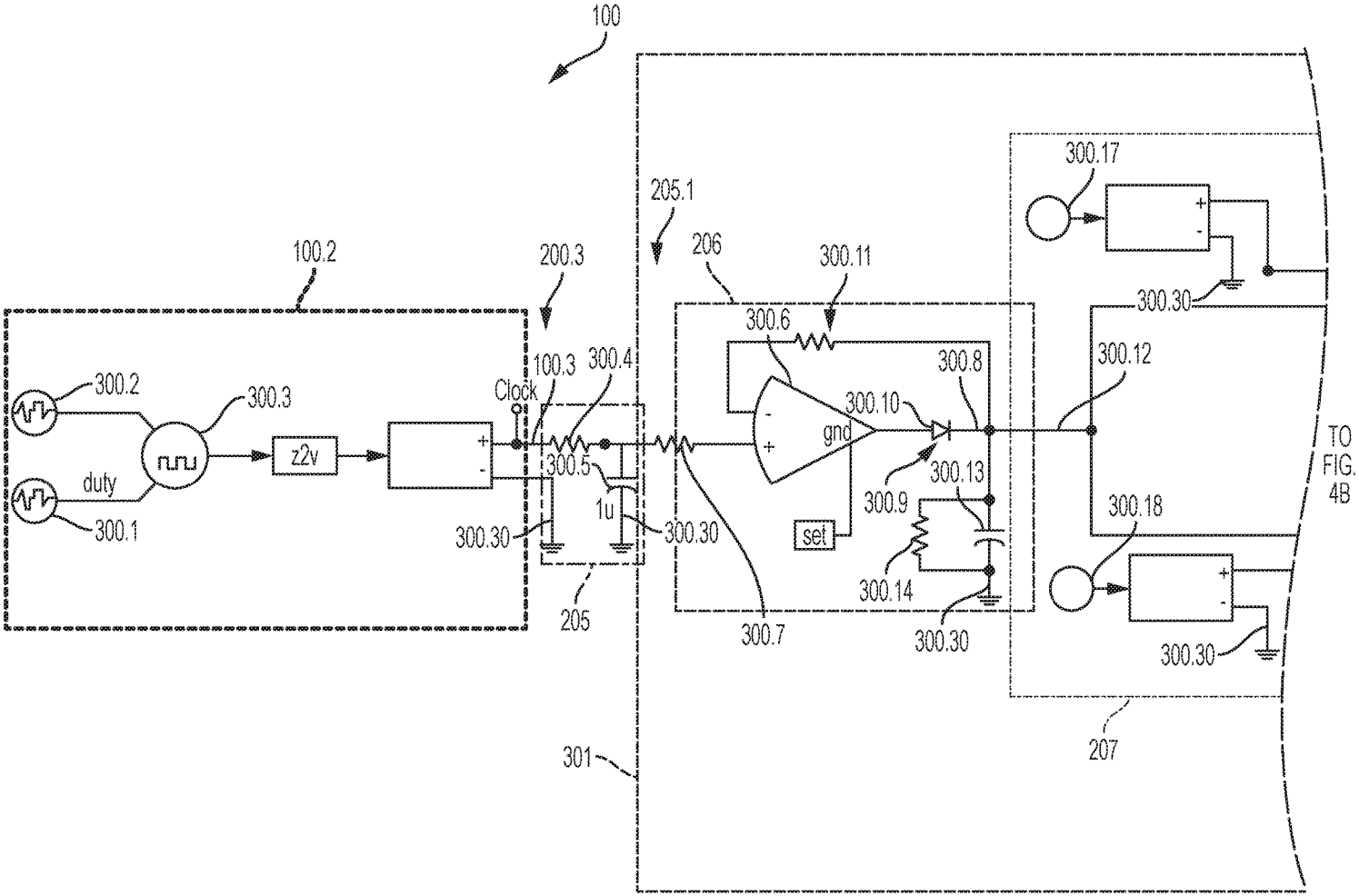
FIGS. 4A and 4B are functional block diagrams of the clock signal monitoring apparatus according to an exemplary embodiment of the present disclosure.
Figure 4B:
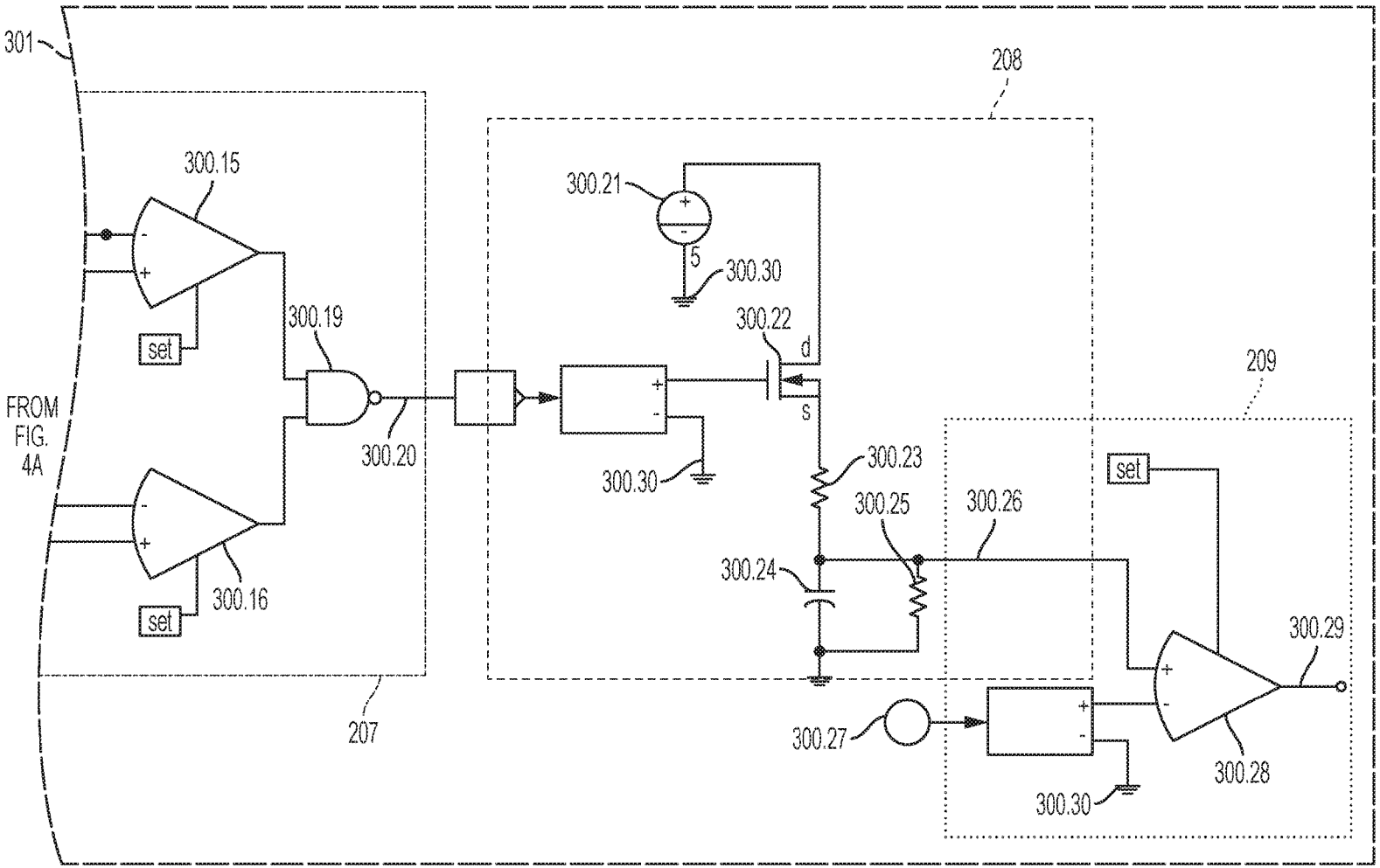

FIGS. 4A and 4B are a detailed block diagrams of the clock signal monitoring apparatus 100.1 according to an exemplary embodiment of the present disclosure. In particular, FIG. 4 shows an electrical circuitry implementing the functionality of a clock signal monitoring apparatus 100.1 realized by purely analog components. For a figurative reason, the block diagram is based on a simulation program simulating the internal clock signal as an exemplary embodiment of the present invention. Based on such a block diagram a respective analog circuit can be derived. The internal clock generator 100.2 or the clock source 100.2 includes two oscillating devices 300.1, 300.2. The oscillating devices 300.1, 300.2 are connected to the clock unit 300.3 in order to generate the rectangular clock signal 200.3 on the output 100.3 of the clock generating device 100.2. The clock signal 200.3 is provided via the output port 100.3 to the signal transformer 205.

Signal transformer 205 includes a resistor 300.4 and a capacitor 300.5. Resistor 300.4 and capacitor 300.5 are arranged in a low pass configuration so that signal transformer 205 forms a low pass filter. Capacitor 300.5 is connected to resistor 300.4 and a common reference potential 300.30 of circuit 100. Resistor 300.4 is also connected to the clock output 100.3. In an example resistor 300.4 has a resistance of 1Ω and capacitor 300.5 has a capacitance of 1 μF.

The clock signal monitoring apparatus 100 includes the signal transformer 205 and a detector 301 in communication with the signal transformer 205. The signal transformer 205 is configured to receive the clock signal 200.3 provided at output 100.3 of clock source 100.2. The clock signal 200.3 has a duty cycle and a frequency. The signal transformer 205 is further configured to convert the clock signal 200.3 into a monitoring signal 205.1 having a peak value 206.3 related to the duty cycle and the frequency of the clock signal 200.3. The clock signal 200.3 has a rectangular waveform and the monitoring signal 205.1 has a triangular waveform.

Detector 301 is configured to receive the monitoring signal 205.1 provided by the signal transformer 205 via link resistor 300.7 and to generate an error signal. The error signal can change between two output values, e.g. between two different voltages. In an example, these two output signals may be named as "clockNOK", "clockfault". These names are used in order to differentiate the two signals within this text. Any other label may be used for these signals. The first error signal "clockNOK" and the second error signal "clockfault" may be generated when the peak value 206.2 of the monitoring signal 205.1 is outside a predefined range 206.4, 206.5. For that purpose, detector 301 includes the active peak detector 206, the comparator for out-of-range detection 207, debouncer 208 and the output comparator 209.

The low pass filter 205 has a cut-off frequency which is configured such that mean value 205.2 of the monitoring signal 205.1 is proportional to the duty cycle of the clock signal 205.1 and such that a ripple of the monitoring signal 205.1 or a peak-to-peak signal of the monitoring signal 205.1 is proportional to the frequency of the clock signal 200.3. In an example, the cut-off frequency of the low pass filter is 1/10 of the frequency of the clock signal 205.1. In an example, the cut-off frequency is predefined. The monitoring signal 205.1 is derived from internal clock signal 200.3 and has a triangular waveform.

Active peak detector 206 is configured to detect a maximum value 206.2 or peak value 206.2 of triangular waveform 205.1 and to provide a signal that substantially constantly provides a signal of the level of the detected peak value. This peak value signal 206.2 of the monitoring signal is provided to a comparator 207 in order to monitor at least one of a first or lower boundary value 206.4 and a second or upper boundary value 206.5. The second boundary value 206.5 is greater than the first boundary value 206.4.

The active peak detector 206 includes a comparator 300.6 or an operational amplifier 300.6. A non-inverting input of comparator 300.6 is connected via link resistor 300.7 to the low pass filter 205. The inverting input of comparator 300.6 is connected to cathode 300.8 of diode 300.9 via feedback resistor 300.11. The anode 300.10 of diode 300.9 is connected to the output of comparator 300.6. Output 300.12 of active peak detector 206 includes a capacitor 300.13 and a resistor 300.14 in a parallel configuration forming an output low pass filter and/or a hold circuit. The comparator 300.6 of active peak detector 206 is arranged in a voltage follower configuration with a high input resistor and a low output resistor. Capacitor 300.13 is loaded via diode 300.9. Capacitor 300.13 may be quickly loaded due to the low output resistor of voltage follower 300.6. Diode 300.9 may prevent discharging of capacitor 300.13. If the signal of the triangular signal 205.1 is in a decreasing phase, capacitor 300.13 still maintains the voltage at this high level, so that the comparator 207 for out-of-range detection permanently receives a peak value of the triangular signal 205.1. If, however, the clock frequency and/or the duty cycle of the clock signal is changed, the peak value that can be stored in capacitor 300.13 is changed too.

In an example, the active peak detector 206 has a link resistor 300.7 of 1Ω, a feedback resistor 300.11 of 1Ω and an output resistor 300.13 of 1Ω. The gain of the comparator 300.6 or OPAMP 300.6 is 100 k. The diode 300.9 has a breakthrough voltage of 0.7 V and the output capacitor 300.13 has a capacitance of 100 μF. Output 300.12 of active peak detector 206 is connected to the comparator for out-of-range detection 207 or to the range monitoring device 207.

Out-of-range detection comparator 207 includes two comparators 300.15, 300.16 which both are connected to the output 300.12 of active peak detector 206. The non-inverting input of upper threshold comparator 300.15 is connected to the output 300.12 of active peak detector 206. The inverting input of lower threshold comparator 300.16 is connected to the non-inverting input of upper threshold comparator 300.15 and to output 300.12. The inverting input of upper threshold comparator 300.15 is connected to an upper reference voltage source 300.17 determining the upper threshold value 206.5. The non-inverting input of lower threshold comparator 300.15 is connected to lower reference voltage source 300.18 determining the lower threshold value 206.4. The output of comparator 300.15 and the output of comparator 300.16 each are connected to a corresponding input of NAND-Gate 300.19. The output 300.20 of NAND-Gate 300.19 defines the output signal of out-of-range detection comparator 207. The out-of-range detector 207 generates a high signal 207.2 if an out-of-range situation is detected, i.e. if the duty cycle and/or the frequency of clock signal 200.3 is outside of a predefined range. The output signal 207.2 of out-of-range detection comparator 207 is provided via output 300.20 to the input of debouncer 208. In an example, the comparator 207 for out-of-range detection includes a comparator high threshold 206.5 of +3.23 V and a comparator low threshold 206.4 of +2.98 V specified by respective reference voltage sources 300.17, 300.18.

Debouncer 208 has a supply voltage 300.21 connected to an electronic switch 300.22, e.g. a transistor 300.22, and to a resistor 300.23 as well as to a capacitor 300.24. Capacitor 300.24 is in a parallel connection with resistor 300.25. One end of capacitor 300.24 and resistor 300.25 forms output 300.26 of debouncer 208. The other end of capacitor 300.24 and resistor 300.25 is connected to common potential 300.30. In an example, the debouncer 208 has a supply voltage 300.21 of 5 V, a resistor 300.23 of 1Ω, a capacitor 300.24 with capacitance of 5 μF and an output resistor 300.25 of 10*g*. The output 300.26 of debouncer 208 is connected to an input of output comparator 209. As long as the NAND 300.19 generates a signal, transistor 300.22 switches and allows the capacitor 300.24 to be loaded by voltage source 300.21 and to generate the signal 208.2, which substantially corresponds to the loading curve of capacitor 300.24. NAND 300.19 delivers the switching signal 207.2 for transistor 300.22 during the time at least one of the outputs of comparators 300.15, 300.16 is active. In other words, if the peak value 206.2, 206.3 of monitoring signal 205.1 generated by active peak detector 206 is within a range 206.4 to 206.5 both outputs of comparators 300.15, 300.16 are high and the output of NAND 300.19 is low. Consequently, transistor 300.22 does not switch and no output signal is generated. If a failure situation in the internal clock 100.2, 300.3 generates a peak value 206.2, 206.3 outside of tolerance range 206.4, 206.5 and lets the output 300.20 of out-of-range detection comparator 207 change to high as well as generates an output signal 207.2 of high level and if this failure situation is continuously present over an interval of at least the minimum detection time 208.3 the detector output 300.29 indicates a failure situation in the internal clock 100.2, 300.3 or a second error state. In an example, this second error state is named as a "clockfault" state. The first and/or second error state signals, e.g. "clocKNOK" and/or "clockfault" are used for the error detection of the internal clock signal.

The output comparator 209 includes voltage source 300.27 and comparator 300.28. The voltage source 300.27 is connected to the inverting input of comparator 300.28 and the output of debouncer 208 is connected to non-inverting input of comparator 300.28. The voltage source 300.27 determines a threshold value 209.1 which is responsible for the time delay 208.3 between first appearing of a failure situation generating the second error state or the failure output signal "clockfault". In other words, the threshold value 209.1 may specify a dead time during which the output 300.29 of comparator 209 or of detector 301 ignores a defective internal clock signal. In an example, voltage source 300.27 or power source 300.27 uses a voltage of 3.5V. Only if a failure situation is present longer than the time delay 208.3 a failure is indicated. If signal 208.2 reaches the threshold value determined by voltage source 300.27, the output 300.29 of output comparator 209 provides a high signal for the second error signal, e.g. the error signal "clockfault", indicating a defective internal clock signal. This second error signal or the failure signal "clockfault" generated by clock signal monitoring apparatus 100.1 can be used to prevent that an external clock signal is replaced by the internal clock signal 100.2, 200.3. If, however, the external clock signal is detected to be defective, the internal clock signal 100.2, 200.3 can be used as a replacement for defective external clock source.

Whether the internal clock signal 100.2, 200.3 or the external clock signal provided via input 102 is used is decided by switch 103.6. Switch 103.6 is controlled by the first and/or second error signal.

Figure 5A:
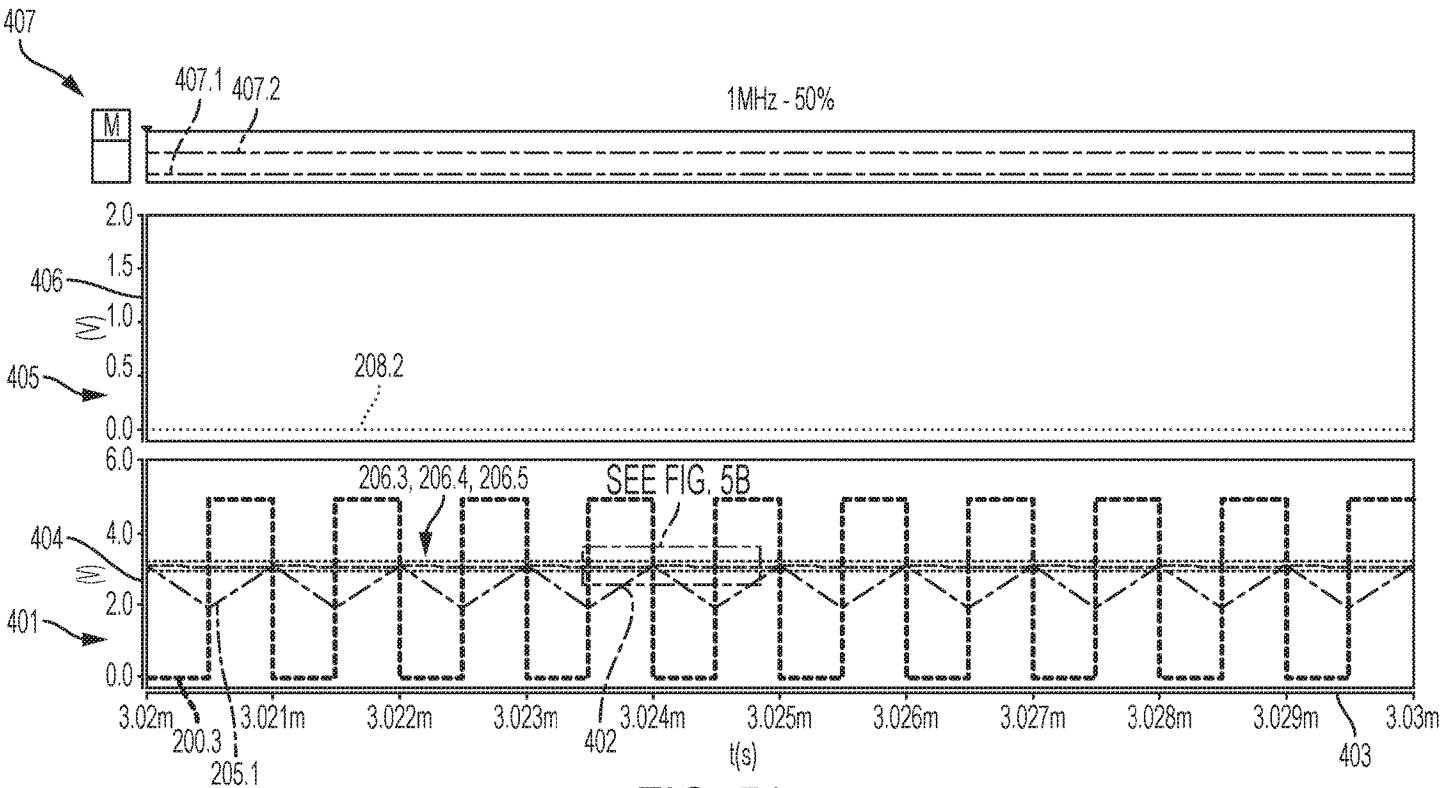
FIGS. 5A and 5B are collections of plots representing output signals of different components of the clock signal monitoring apparatus as a function of time according to an exemplary embodiment of the present disclosure.
Figure 5B:
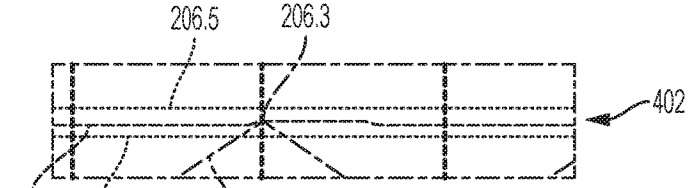

FIGS. 5A and 5B are a collection of plots representing output signals of different components of the clock signal monitoring apparatus 100 as a function of time according to an exemplary embodiment of the present disclosure. Diagram 401 of FIG. 5 represents the rectangular waveform of clock signal 200.3, the triangular waveform of monitoring signal 205.1, the peak signal 206.2, the lower threshold 206.4 and the upper threshold 206.5 of the peak detector's acceptable range. The triangular wave signal 205.1 is a filtered clock signal 205.1. The lower threshold 206.4 signal is a constant value determining a lower threshold and upper threshold 206.5 signal is a constant value determining an upper threshold. In a particular example the lower and upper threshold signals 206.4, 206.5 correspond to upper power source 300.17 and lower power source 300.18, respectively. Peak value signal 206.2 is the output signal of peak detector device 206. A detailed view of curves 206.2, 206.4, 206.5 and their relation to another is provided in the detailed diagram 402. The abscissa 403 of diagram 401 ranges from 3.02 ms to 3.03 ms. The ordinate 404 ranges from 0 V to 6.0 V. The frequency of clock signal 200.3 is pre-set to 1 MHz with a duty cycle of 50% letting peak value signal 206.2 lie between the lower and upper threshold values 206.4, 206.5. A duty cycle of 50% means that the clock signal 200.3 is 50% of a period low or 0V and 50% of the period high or 5V as for example can be seen in the first period of signal 200.3 ranging from 3.02 ms to 3.021 ms.

Diagram 405 shows the output signal 208.2 of debouncer 208 at 0V corresponding to a low level. This low signal indicates a correctly working clock source 100.2, 300.3. The ordinate 406 of diagram 405 ranges from 0 to 2.0 V.

Diagram 407 shows two signals indicating different levels of detected clock failures, i.e. a first error signal 407.1 and a second error signal 407.2. In this particular example presented in FIGS. 5, 6, 7, clock failure of internal clock signal 200.3 are indicated by a "clockNOK" signal 407.1 and clock fault signal "clockfault" 407.2. The first clock failure signal "clockNOK" 407.1 reaching a predefined value indicates that actually a failure situation of the clock signal exists. This can be a temporary error that is cancelled over the time by a sort of self-healing process. The second clock failure signal "clockfault" 407.2 reaching a predefined value indicates that a clock failure has been present over an inacceptable long time and triggers an alarm and/or a failure handling routine. In FIG. 5, where the predefined clock frequency and duty cycle are provided both signals "clockNOK" 407.1, "clockfault" 407.2 remain unchanged in their original state and therefore these signals indicate that no problem exists with the internal clock signal 200.3. Consequently, if a discrepancy is detected between the internal clock signal 200.3 and the external clock signal 102.1 the external clock signal 102.1 may be classified as defective and the controller may switch from external clock signal 102.1 to internal clock signal 200.3 in order to recover the clock signal.

Figures 1, 6A:
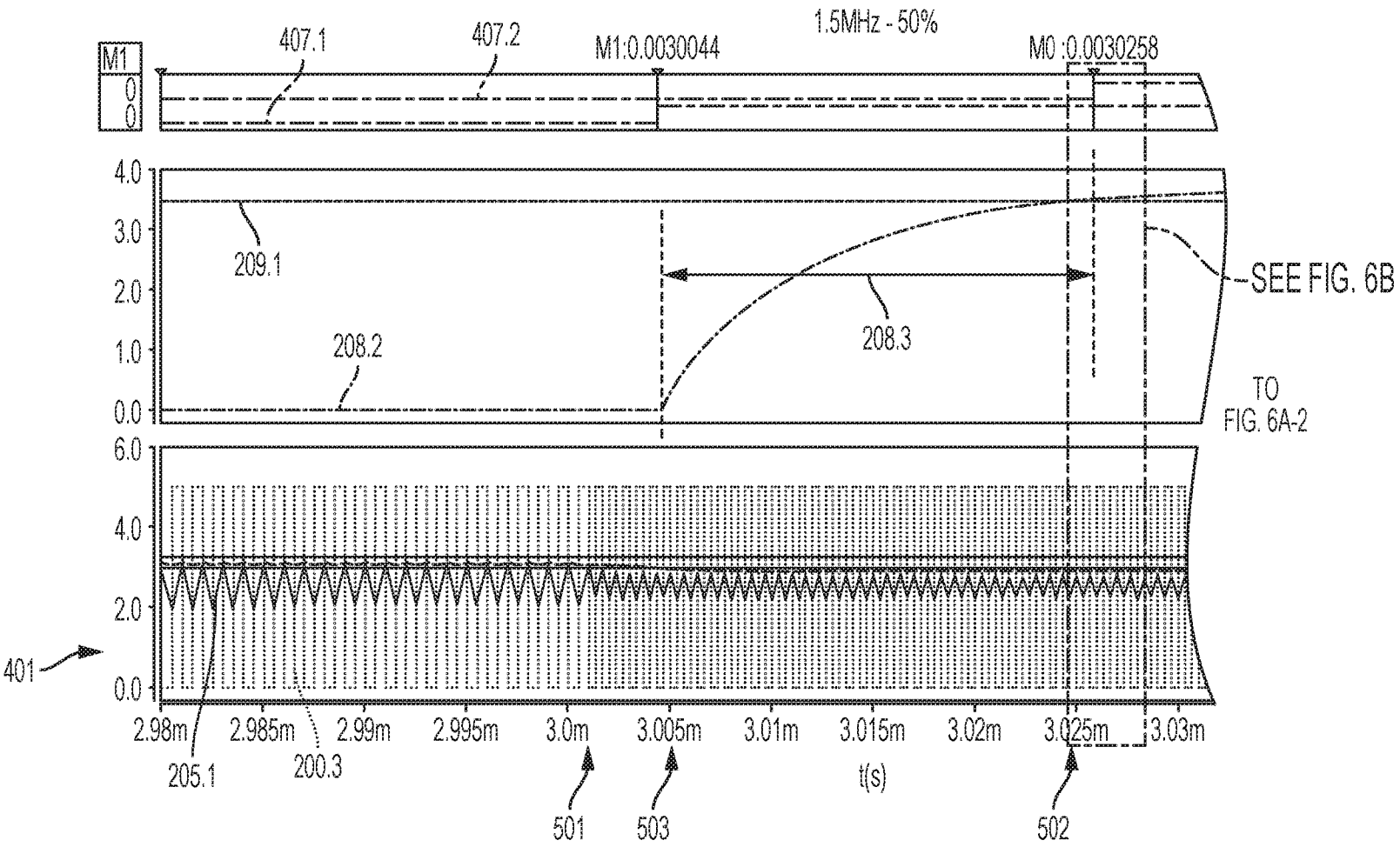
Figure 6B:
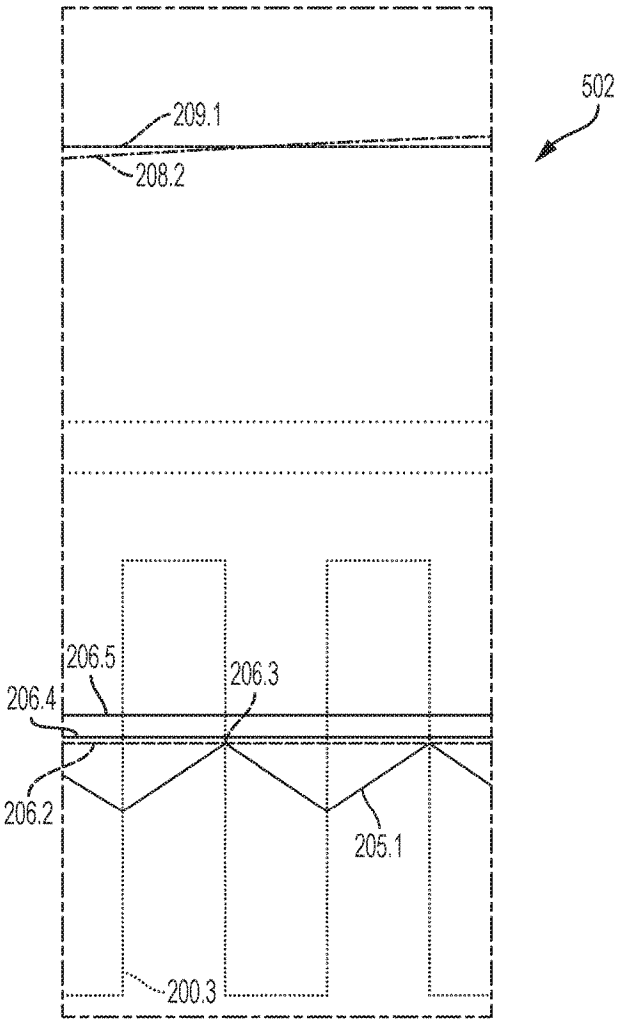
Figures 2, 6A:
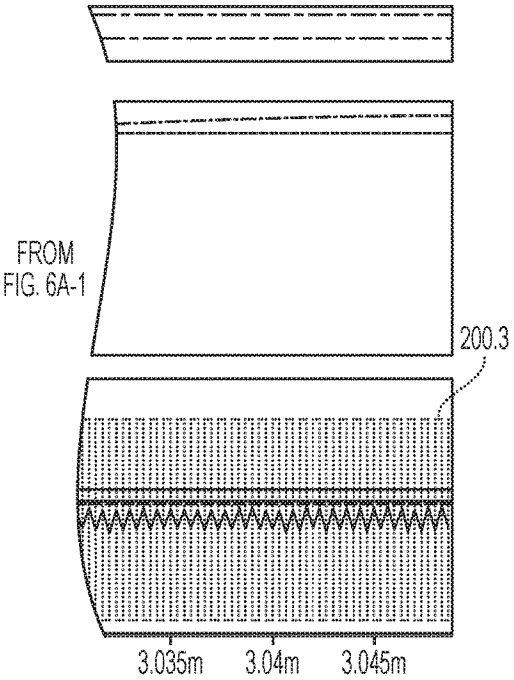

FIGS. 6A-1, 6A-2 and 6B are a collections of plots representing output signals of different components of the clock signal monitoring apparatus 100 as a function of time where the frequency of the clock signal 200.3 is outside a tolerance range according to an exemplary embodiment of the present disclosure. The frequency of clock signal 200.3 is changed from 1 MHz to 1.5 MHz and the duty cycle is maintained at 50%. In this case, the debouncer signal 208.2 increases as the frequency is NOK (not OK) or the frequency is faulty. The increase of the debouncer signal 208.2 appears because the peak detector output is out of range. The accepted frequency range is chosen as to be 825 kHz-1.2 MHz. If the frequency of clock signal 200.3 is within this frequency range 825 kHz-1.2 MH, the peak value signal 206.2 will lie between lower and upper thresholds 206.4, 206.5, e.g. within 2.98V and 3.23V. If, however, the frequency of clock signal 200.3 is outside of the acceptable frequency range 825 kHz-1.2 MHz, a fault is detected. In this situation, the "clockfault" signal 407.2 is "1" or high. As shown in FIG. 6 at point in time 3 ms 501, the frequency of the clock signal 200.3 is increased from 1 MHz to 1.5 MHz. The triangular wave signal 205.1 or monitoring signal 205.1 reduces the ripple or peak-to-peak value of the triangular wave signal 205.1. As indicated in the detailed view 502 (FIG. 6B), the clock signal 200.3 changes the ripple of triangular signal 205.1 in such a way that the peak value 206.3 and/or peak value curve 206.2 of triangular wave 205.1 lays outside the range defined by lower threshold 206.4 and higher threshold 206.5. As a consequence, at time indicated by reference sign 503, at 3.005 ms or at 0.0030044 s debouncer output signal 208.2 increases by loading capacitor 300.24 and converges towards output comparator threshold 209.1. Threshold value 209.1 or limit value 209.1 determines the acceptable detection time 208.3.

At the moment indicated by reference sign 503 when curve 208.2 starts growing, the first error signal "clockNOK" 407.1 changes from low to high state indicating a temporary degradation of the clock quality. After passing the tolerable out-of-range time 208.3, at the moment 3.0258 ms (M0) also the second error signal 407.2 or the clock fault signal "clockfault" 407.2 changes from low to high indicating that a temporary failure in the clock signal has been present too long and an inacceptable error situation in the clock signal is indicated. With regard to a clock error a first clock error signal, e.g. clockNOK, and a second clock error signal exist, e.g. clockfault. The first clock error signal clockNOK indicates whether the peak value 206.2 is out of range or not. The second clock error signal clockfault means that the fault has been debounced or has been existing over too long time and therefore it is validated. In other words, the clockfault signal set to a high value indicates that the duration of a faulty clock situation exists over a predefined period. Thus, clockNOK indicates a temporary degradation of the internal clock signal while clockfault means an unhealable degraded clock signal.

Clock failure signal clockNOK 407.1 having a high value or a high state indicates that a backup to the internal clock source is to be prevented since a frequency error has appeared. The minimum detection time 208.3 is 21 μs. This time limit 208.3 can be set up by dimensioning the debouncer filter and in particular by dimensioning the capacitance 300.24 of debouncer 208. The detection time duration is dimensioned in such a way that the system can tolerate over that duration the faulty clock without substantially being damaged. The detailed view 502 of diagram 401 in FIG. 6A-1 shows peak detector output signal 206.2 outside of the acceptable range between range borders 206.4 and 206.5.

In an example, the detector 301 includes a peak value comparator 207 configured to compare the peak value 206.2, 206.3 of the monitoring signal 205.1 to at least one of a first boundary value 206.4 of the predefined range and a secondary boundary value 206.5 of the predefined range. The secondary boundary value is greater than the first boundary value. The peak value comparator 207 has an output where an out-of-range signal 207.2 is provided for the time during which the peak value is below the first boundary 206.4 value and/or the peak value is above the second boundary value 206.5. The first error signal clockNOK 407.1 is linked to output signal 207.2 of out-of-range detection comparator 207. The second error signal clockfault 407.2 is provided at output 300.29 of output comparator 209. This second error signal 407.2 is provided at the output 300.29 of comparator 209. The second error signal 407.2 is a failure signal that has been debounced. In other word, the second error signal 407.2 is a failure signal indicating that a first error signal 407.1 has been existing in a stable condition exceeding a predefined time period.

Figure 7A:
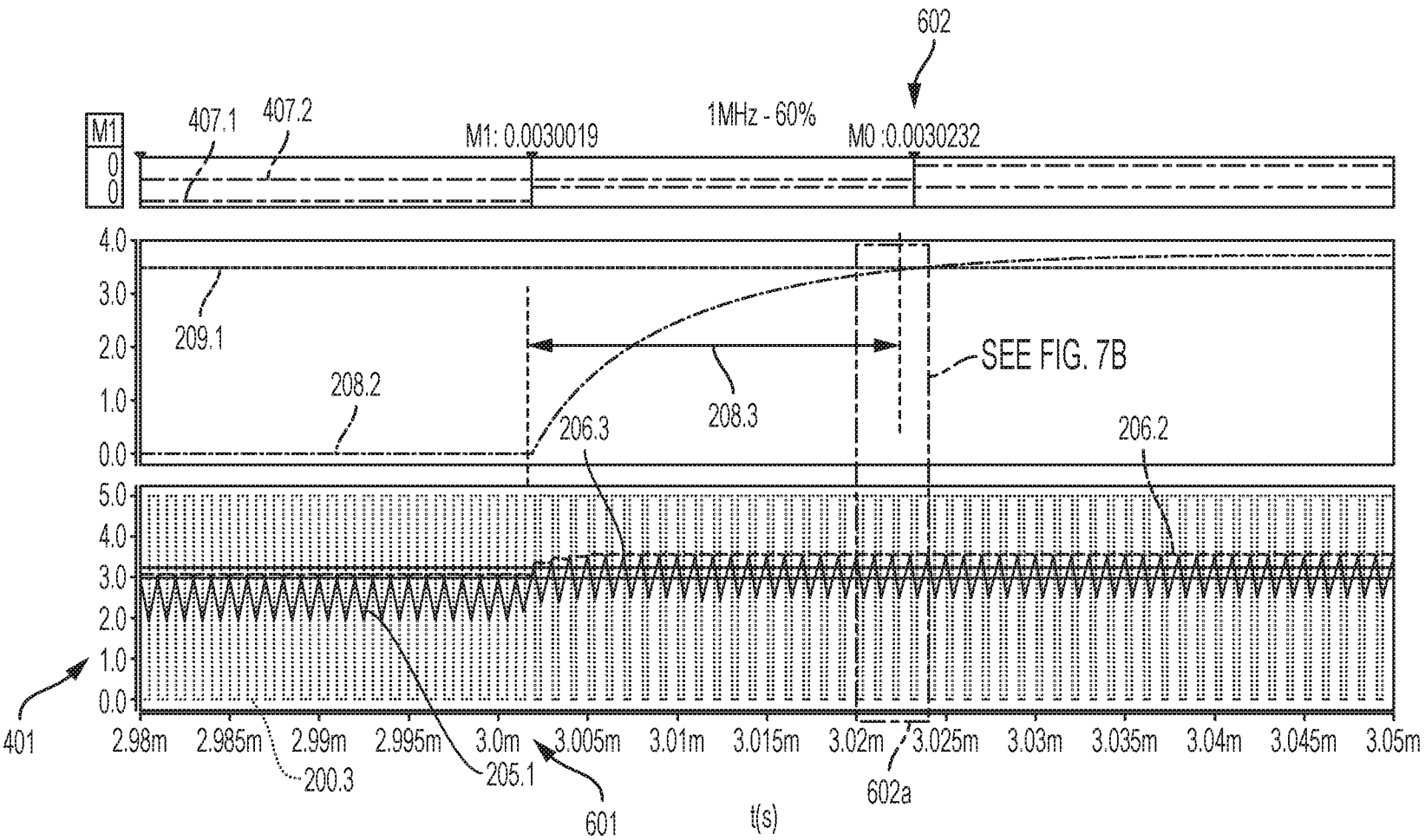
FIGS. 7A and 7B are collections of plots representing output signals of different components of the clock signal monitoring apparatus as a function of time where the duty cycle of the monitored clock signal is outside a tolerance range according to an exemplary embodiment of the present disclosure.
Figure 7B:
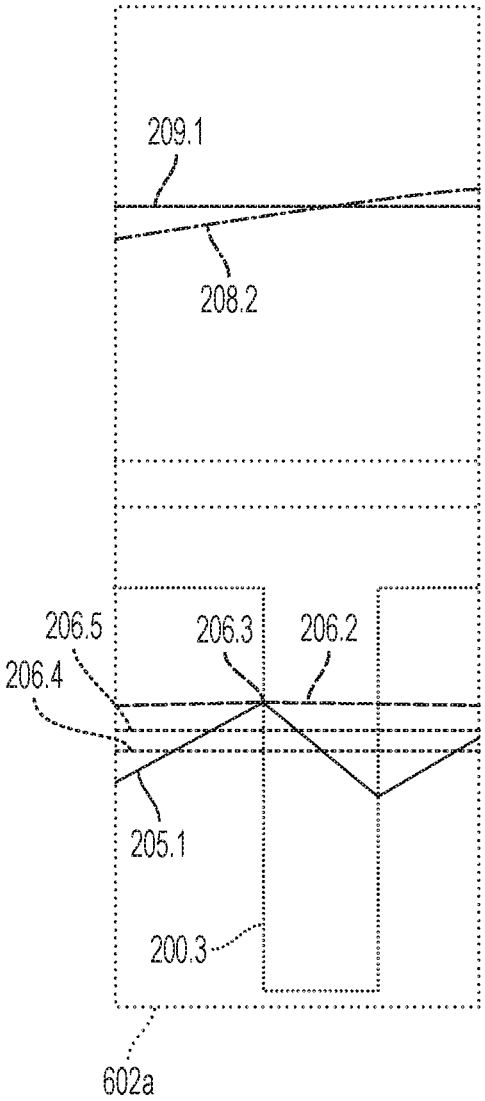

FIGS. 7A and 7B are a collection of plots representing output signals of different components of the clock signal monitoring apparatus 100 where the duty cycle of the clock signal 200.3 is outside a tolerance range according to an exemplary embodiment of the present disclosure. The clock frequency in FIGS. 7A and 7B are selected as the pre-set clock frequency 1 MHz. The duty cycle is set to 60%, i.e. a value 10% higher than the predetermined duty cycle of 50% and therefore outside a tolerance range for the duty cycle. In this case, the debouncer signal 208.2 increases and the frequency is faulty or NOK, i.e. not OK, because the peak detector output is out of range. In this situation fault is detected, because the first clock fault signal clockfault is "1". Diagram 401 of FIG. 7A shows the clock signal 200.3 with the constant predetermined frequency of 1 MHz. At time value around 3 ms (3.019 ms) indicated by reference signs 601, M1 the duty cycle of the clock signal 200.3 is changed. As a result of the change in the duty cycle, the peak value 206.3 of peak value curve 206.2 of triangular wave signal 205.1 increases to around 3.5 V by increasing the mean value of monitoring signal 205.1. As shown in the detailed view 602*a* of FIGS. 7A and 7B after changing the duty cycle at moment in time 601, the peak value 206.3 lays outside the acceptable frequency range from lower threshold 206.4 of 825 kHz to upper threshold value 206.5 of 1.2 MHz. As a result of this increase in the peak value curve 206.2, the debouncer output signal 208.2 increases after time indicated by reference sign 601 where the duty cycle changes. After the detection time 208.3 at point in time 602, M0 of 3.0232 ms, the debouncer output signal 208.2 reaches the maximum allowable threshold value 209.1 set with output comparator 209. The minimum detection time is about 21 μs and depends only on the debouncer filter. In particular, the time limit 208.3 may be set by dimensioning of the capacitor 300.24 of debouncer and/or by dimensioning the reference voltage 300.27 of output comparator 209. The first clock fault signal clockNOK 407.1, 207.2 changes at time 601, M1 from low to high and indicates a temporary degradation of the internal clock signal, when peak value curve 206.2 exceeds one of the threshold values 206.4, 206.5. The second clock fault signal "clockfault" 407.2 changes at time 602, M0 3.0232 ms from low to high indicating that an inacceptable degradation of the internal clock signal exists making the internal clock signal unusable. As indicated in the detailed view 602*a* (FIG. 7B), the peak value signal 206.2 is outside of the acceptable range between 206.4 and 206.5. In the above described configuration of a pure analog circuit 100.1 the circuit 100.1 is configured to detect a duty error and/or a frequency error.

In one example of the present disclosure, the detector 301 includes a debouncer which increases a debouncer output signal over the time during which the peak value comparator 207 outputs the out-of-range signal 207.2. The debouncer output signal is then compared with a predefined threshold in order to recognize that a faulty situation exists. In another example, the detector 301 includes an error signal generator 209 or output comparator 209 being designed to compare the debouncer output signal 208.2 to a predefined threshold 209.1 and to generate the second error signal "clockfault" 407.2 after the first error signal exists longer than a predefined time period. If the second failure signal 407.2, e.g. "clockfault" is set to a high value the internal clock signal is marked as defective.

An injector driver 100 for a vehicle and in particular a clock arbitration module 250 of the injector driver 100 includes an external clock signal terminal 203 configured to provide an external clock signal 103.2 and an internal clock signal terminal 204 configured to provide an internal clock signal 200.3 as well as a clock signal monitoring apparatus 100.1 in line with this disclosure, wherein the signal transformer 205 of the clock signal monitoring apparatus 100.1 is connected to the internal clock signal terminal 204 via link 100.3.

Figure 8:
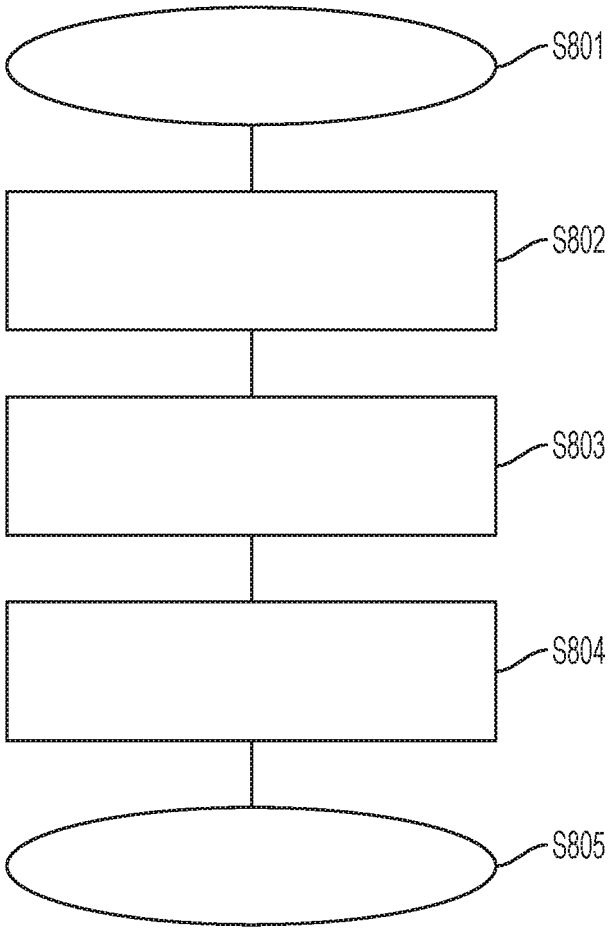
FIG. 8 is a flow chart for a method for monitoring a clock signal according to an exemplary embodiment of the present disclosure.

FIG. 8 is a flow chart of a method for monitoring a clock signal according to an exemplary embodiment of the present disclosure. The method starts in the idle state S801. In state S802, a clock signal 200.3 is received in a signal transformer 205, wherein the signal 200.3 has a duty cycle and a frequency. In state S803, the signal transformer 205 converts the clock signal into a monitoring signal having a peak value related to the duty cycle and to the frequency of the clock signal. In state S804, the monitoring signal is received in a detector 301 connected to the signal transformer 205 and a second error signal "clockfault" 407.2 is generated by the detector when the peak value 206.3, 206.2 of the monitoring signal 205.1 is outside a predefined range 206.4, 206.5. The method ends in end state S805.

By using an analog circuitry and/or analog components, the reliability for detecting the clock fault is high. If the described method is realized as a program code and runs on a processor also a high reliability for detection may be achieved by using components and/or devices, e.g. a processor, that use a dedicated clock source, i.e. a clock source that substantially only supplies the component executing the program code with a clock signal. In this way, the processor may be independent from external impact such as an impact from an external clock source. In other words, if this method is implemented by software or as a computer program running on a processor an additional monitoring circuitry may be provided in order to ensure that the clock signal of the processor is monitored by an additional method. The additional method may assure that the processor is working as desired. The additional monitoring circuit may comprise an additional clock monitoring apparatus. In an example, the additional monitoring circuit is also implemented as a pure analog circuit.

The method may further comprise transmitting a second clock signal from a second clock source when an error signal is generated. The second clock signal may be an internal clock signal. Under normal conditions the external clock is used. The internal clock source may be selected when a fault condition of the external clock is detected. If, however, both clock sources are in faulty conditions the method prevents switching to the internal clock in order to prevent any confusion about the status of the clock source. In this case of both clock sources being defective, the error signal is generated, however, the clock monitoring apparatus continues using the external clock and prevents switching to the internal clock source. A defective internal clock source may be indicated by setting the second error signal 407.2, e.g. "clockfault", to a high value. In an example, a failure in the external clock may be detected by comparing the external clock with the internal clock. Since the internal clock may be used as a reference the internal clock is to be protected from failures with a high priority. For example, the internal clock may be encapsulated or sealed off from any external impact. Alternatively, or in addition, substantially purely analog components may be used for the internal clock and for a respective clock signal monitoring apparatus. Preventing faulty conditions of the internal clock may allow for using the internal clock as a reference. In case the internal clock may be damaged and thus the signal generated by the internal clock may be erroneous, a verification of the external clock might be difficult and an assessment of the condition of the external clock may have to be prevented. In such a case of a defective internal clock it may substantially be impossible to understand whether the external clock is faulty as well. In an example, an indication device may exist for indicating that no assessment of the failure condition of a clock signal is possible when such ambiguous condition be detected.

As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Example embodiments are provided so that this disclosure will be thorough, and will convey the scope to those who are skilled in the art. Details may be set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies may not be described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. Likewise, the terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

The methods, steps, processes, and operations described herein are not to be construed as necessarily requiring their performance in the particular order discussed or illustrated, unless specifically identified as an order of performance. It is also to be understood that additional or alternative steps may be employed.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A control system for controlling a fuel injector of a vehicle, comprising:

an injection driving device configured to drive fuel injection of the fuel injector based on a first clock signal;

a signal transformer configured to receive the first clock signal, the first clock signal having a duty cycle and a frequency, the signal transformer configured to convert the first clock signal into a monitoring signal having a peak value related to the duty cycle and the frequency of the clock signal;

a detector in communication with the signal transformer and configured to receive the monitoring signal and detect an error in the first clock signal when the peak value of the monitoring signal is outside a predefined range;

wherein the injection driving device is configured to drive fuel injection of the fuel injector based on a second clock signal instead of the first clock signal when the error in the first clock signal has been detected.

2. The control system according to claim 1, wherein the signal transformer comprises a low pass filter.

3. The control system according to claim 2, wherein the low pass filter has a cut-off frequency such that a mean value of the monitoring signal is proportional to the duty cycle of the first clock signal and a ripple of the monitoring signal is proportional to the frequency of the first clock signal.

4. The control system according to claim 2, wherein the low pass filer has a cutoff frequency equaling one-tenth of the frequency of the first clock signal.

5. The control system according to claim 1, wherein the monitoring signal comprises a triangular waveform signal.

6. The control system of claim 1, wherein the detector comprises a peak value comparator configured to:

compare the peak value of the monitoring signal to at least one of a first boundary value of the predefined range and a second boundary value of the predefined range, which is greater than the first boundary value; and output an out-of-range signal for the time during which the peak value is below the first boundary value or the peak value is above the second boundary value.

7. The control system of claim 6, the detector comprising a debouncer configured to receive the out-of-range signal and to increase a debouncer output signal over the time the peak value comparator outputs the out-of-range signal.

8. The control system of claim 7, the detector comprising an error signal generator configured to compare the debouncer output signal to a predefined threshold and to generate the error signal when the debouncer output signal is greater than the predefined threshold.

9. The control system of claim 1, wherein the signal transformer and the detector comprise analog components.

10. The control system of claim 1, further comprising:

an external clock signal terminal configured to provide the second clock signal as an external clock signal; and an internal clock signal terminal configured to provide the first signal as an internal clock signal;

wherein the signal transformer is connected to the internal clock signal terminal.

11. The control unit of claim 1, wherein the injection driving device includes an output terminal configured to output one of the first and second clock signals;

further comprising a switch configured to switch output of the output terminal between the first and second clock signals; and wherein the injection driving device is configured to generate a driving signal for driving fuel injection of the fuel injector, the driving signal based on the one of the first and second clock signals that is output by the output terminal; and wherein the injection driving device is configured to switch the switch according to the monitoring signal.

12. The control unit of claim 11, wherein the injection driving device is configured to prevent the switch from switching as a result of the error being detected, thereby preventing the output terminal from outputting the first clock signal.

13. The control unit of claim 11, wherein the injection driving device is configured to switch the switch as a result of the error being detected, thereby changing output of the output terminal from the first clock signal to the second clock signal.

14. A method for controlling a fuel injector of a vehicle with a control system comprising:

driving fuel injection of the fuel injector with an injection driving device of the control system based on a first clock signal;

receiving, by a signal transformer of the control system, the s-first clock signal from a first clock source, the first clock signal having a duty cycle and a frequency;

converting the first clock signal with the signal transformer into a monitoring signal having a peak value related to the duty cycle and to the frequency of the first clock signal;

receiving the monitoring signal in a detector of the control system, the detector connected to the signal transformer;

detecting, with the detector, an error in the first clock signal when the peak value of the monitoring signal is outside a predefined range; and driving fuel injection by the fuel injector with the injection driving device based on a second clock signal instead of the first clock signal when the error in the first clock signal has been detected.

15. The method according to claim 14 further comprising:

comparing the peak value of the monitoring signal to at least one of a first boundary value of the predefined range and a second boundary value of the predefined range, which is greater than the first boundary value; and outputting an out-of-range signal for the time during which the peak value is below the first boundary value or the peak value is above the second boundary value.

16. The method according to claim 15, further comprising increasing a debouncer output signal over a time period that the out-of-range signal is outputted.

17. The method according to claim 16, further comprising generating an error signal when the debouncer output signal is greater than the predefined threshold.

18. A non-transitory computer readable medium comprising programming code including computer instruction, which when executed by a processor, executes the method according to claim 14.

19. The method of claim 14, wherein the control system includes an output terminal configured to output one of the first and second clock signals;

wherein the control system includes a switch configured to switch output of the output terminal between the first and second clock signals;

wherein driving fuel injection includes generating a driving signal for driving fuel injection of the fuel injector, the driving signal based on the one of the first and second clock signals that is output by the output terminal; and further comprising preventing the switch from switching, thereby preventing the output terminal from outputting the first clock signal as a result of the error being detected.

20. The method of claim 14, wherein the control system includes an output terminal configured to output one of the first and second clock signals;

wherein the control system includes a switch configured to switch output of the output terminal between the first and second clock signals;

wherein driving fuel injection includes generating a driving signal for driving fuel injection of the fuel injector, the driving signal based on the one of the first and second clock signals that is output by the output terminal; and further comprising switching the switch as a result of the error being detected, thereby changing output of the output terminal from the first clock signal to the second clock signal.

* * * * *